US005209634A

United States Patent [19]

Owczarek

[11] Patent Number: 5,209,634

[45] Date of Patent: May 11, 1993

[54] ADJUSTABLE GUIDE VANE ASSEMBLY FOR THE EXHAUST FLOW PASSAGE OF A STEAM TURBINE

[76] Inventor: Jerzy A. Owczarek, 2345 Overlook Dr., Bethlehem, Pa. 18017

[21] Appl. No.: 658,224

[22] Filed: Feb. 20, 1991

[51] Int. Cl.[5] ..... F01B 25/02

[52] U.S. Cl. ..... 415/150; 415/26; 415/208.2; 415/211.2

[58] Field of Search ..... 415/150, 148, 149.1, 415/149.2, 26, 211.2, 208.2, 208.1

[56] References Cited

U.S. PATENT DOCUMENTS

| | | | |
|---|---|---|---|
| 787,039 | 4/1905 | Harris | 415/148 |
| 2,944,786 | 7/1960 | Angell et al. | 415/148 |
| 3,005,887 | 10/1961 | Robson | 415/148 X |
| 3,080,824 | 3/1963 | Boyd et al. | 415/148 X |
| 3,772,886 | 11/1973 | Cameron | 415/149.2 X |
| 4,391,564 | 7/1983 | Garkusha et al. | 415/148 X |

FOREIGN PATENT DOCUMENTS

| | | | |
|---|---|---|---|
| 8000989 | 3/1980 | World Int. Prop. O. | 415/148 |

*Primary Examiner*—Richard A. Bertsch
*Assistant Examiner*—Todd Mattingly
*Attorney, Agent, or Firm*—Joseph J. O'Keefe; Charles A. Wilkinson

[57] ABSTRACT

Apparatus for controlling the steam pressure at the exit of the last row of blades of a steam turbine by means of an adjustable guide vane assembly having a plurality of vane segments supported by the bearing cone that are moved to change the cross-sectional area of the exhaust flow passage so as to improve turbine efficiency under varying operating conditions by minimizing the average pressure in the annulus following the last row of turbine blades.

9 Claims, 6 Drawing Sheets 60
61
62
63
64
65
66
67
68
69
70
71
72
28
30°
40
43
45
49
50A
84
86
87
88

10
11
12
13
14
15
16
17
20
21
22
23
24
25
26
27
28
40
41
42
43
44
45
46
47
48
49
50A
80
81
82
83
84
85
86
90
91
92
93
94
95
B
B'
C
C'
F
X
X'
3

ADJUSTABLE GUIDE VANE ASSEMBLY FOR THE EXHAUST FLOW PASSAGE OF A STEAM TURBINE

FIELD OF THE INVENTION

This invention relates to apparatus for controlling the steam pressure at the exit of the last row of blades of a steam turbine. More particularly, this invention relates to adjustable guide vane or guide vanes mounted circumferentially of the axis of a condensing steam turbine which may be operated to change the cross-sectional area of the exhaust flow passage after the last row of turbine blades to control and to minimize the pressure of steam adjacent the exit of the last row of blades in response to varying conditions of the turbine's operation.

BACKGROUND OF THE INVENTION

In large steam turbines used in power generation, steam leaving the last row of turbine blades flows through an annulus between the turbine enclosure or casing and the bearing cone into a collector called the "exhaust hood" and then to a condenser. The vast majority of exhaust hoods of condensing steam turbines are of the "downward-discharging" type in which the condenser is located below the exhaust hood. Although the following description is applicable particularly to turbines with "downward-discharging" types of exhaust hoods, it applies broadly to other types of turbines.

At the outer radius of the last turbine blade annulus there is usually located a fixed, outer guide vane of circumferentially uniform shape which extends for 360° with respect to the turbine axis of rotation. The fixed, outer guide vane is usually made of two 180° segments, one placed above and the other placed below the horizontal plane of the turbine shaft longitudinal axis. The inner surface of the outer guide vane and the outer surface of the turbine bearing cone form an exhaust flow passage in which the steam passing from the last turbine blades is, preferably, decelerated or, in other words, diffused. The diffusion causes a decrease in kinetic energy of the steam and a corresponding increase in pressure from the last turbine blades to the exhaust flow passage exit. This exhaust flow passage exit pressure is influenced by the pressure in the condenser located after the exhaust hood. Since with diffusion there is an increase, in the flow direction, of steam pressure in the exhaust flow passage, there is a corresponding decrease in pressure of the steam at the exit of the last row of turbine blades below the exhaust hood pressure and a corresponding increase in turbine work output as compared to the work output which would occur in the absence of diffusion.

The average exhaust hood pressure at the exhaust flow passage exit is close to the pressure in the condenser following the exhaust hood. However, the average exhaust hood pressure is somewhat higher because of the pressure losses that occur due to struts and beams located, for reinforcing purposes, throughout the exhaust hood, some being near the condenser flange and in the condenser neck. For a given condenser pressure, which depends on the temperature of the condenser cooling water, the higher is the pressure rise caused by the diffusion process in the exhaust flow passage, the lower is the pressure at the exit of the last row of turbine blades and the higher is the turbine work output for given turbine inlet conditions.

The pressure in an exhaust flow passage varies circumferentially relative to the turbine axis. Because of internal pressure losses, the pressure in the top portion of a downwardly-discharging exhaust hood is higher than in the bottom portion, which is closer to the condenser inlet. At the same time, the level of pressure in the exhaust hood is affected by the condenser pressure which depends on the cooling water temperature and on the steam flow rate. In the summer the cooling water temperature in the condenser and the corresponding condenser pressure are higher than in the winter. An outer guide vane having a fixed shape designed for flow conditions at the exit of the last row of turbine blades prevailing during one season, e.g. winter, will not perform as well in a different season, e.g. summer. Also, if the turbine load and with it the steam flow rate were to decrease below the design load, a fixed guide vane designed for the full load would not perform well.

At present, no matter what type of exhaust hood is used for a turbine, manufacturers of such equipment make the exhaust end outer guide vanes fixed and in general of uniform shape; that is the shape of the guide vane is fixed and, in general, it does not vary circumferentially from one position to another. Generally, the guide vanes are designed to perform well at flow conditions corresponding to very low condenser pressures, usually those corresponding to winter conditions and full load. Consequently, such fixed guide vanes do not perform equally well for the high condenser pressures which occur during the summer months. In addition, in downwardly-discharging exhaust hoods, uniformly shaped guide vanes do not provide optimum exhaust flow passages for the varying steam flow conditions around the last blade annulus. The flow conditions vary because, as has been mentioned already, as a consequence of the pressure losses, the pressure at the top portion of such exhaust hoods is higher than in the bottom portion. Present exhaust steam turbines have fixed exhaust guide vanes designed to operate at certain selected conditions. Heretofore no effort has been made to change the shape of the exhaust flow passages in response to varying conditions of turbine operation by making the guide vanes adjustable or by any other modification.

OBJECTS OF THE INVENTION

The desired geometry of a steam turbine exhaust flow passage is related to the flow conditions because, for a given ratio of the exit to inlet areas of a diffusing passage, or diffuser, the amount of diffusion, expressed as a ratio of the exit to inlet pressure, is related to the flow Mach number at the inlet. In an exhaust flow passage of a steam turbine, this flow Mach number corresponds to the average flow Mach number at the exit of the last row of blades. Its value changes as changes occur in the flow conditions, such as the condenser pressure or steam flow rate, and, as a result, the amount of diffusion in the exhaust flow passage, if any, also changes, and can become less than the amount which could be obtained if an adjustment were made to the exit-to-inlet heights, or geometry, of the exhaust flow passage.

In addition, the area ratio, which corresponds to the exit-to-inlet heights ratio, of the exhaust flow passage of a steam turbine having a fixed guide vane may be too large for given flow conditions. In such case, flow separation will occur in the exhaust flow passage and little or no diffusion will take place unless this area ratio is decreased and flow separation is eliminated. As used herein, "exhaust flow passage" shall mean the area bounded by an outer guide vane or vanes and either the bearing cone or an inner guide vane or vanes, as the case may be, beginning after the last row of turbine blades and ending at the location of exit into the exhaust hood. The "cross-sectional area" of the exhaust flow passage shall mean the area of such passage lying in a plane passing through the turbine shaft longitudinal axis.

Thus, it is the main object of this invention to provide apparatus at the exit end or ends of a condensing steam turbine to modify the cross-sectional area of the exhaust flow passage at various locations circumferentially of the turbine shaft longitudinal axis in accordance with varying turbine operating conditions to promote optimum performance of the turbine.

It is another object of this invention to provide a series of movable guide vanes after the last blade row of a condensing steam turbine to change the cross-sectional area of the exhaust flow passage at various locations circumferentially of the turbine shaft longitudinal axis in accordance with varying operating conditions to improve turbine performance.

SUMMARY OF THE INVENTION

The objects of the invention are accomplished by providing in a steam turbine an adjustable guide vane assembly comprising a plurality of movable vanes associated with the exhaust end of the turbine casing for at least a portion of the 360° circumference about the turbine shaft longitudinal axis. In the portion of the casing having the adjustable guide vane assembly, the guide vanes can be adjusted so that they can be moved to change the cross-sectional area of the exhaust flow passage so as to improve the turbine efficiency under varying operating conditions by minimizing the average pressure in the annulus immediately following the last row of turbine blades.

In another embodiment of the invention an adjustable guide vane assembly associated with the exhaust end of the turbine casing for at least a portion of the 360° circumference about the turbine shaft axis comprises a plurality of adjustable vanes that move axially with respect to the casing. Movement of the vanes changes the cross-sectional area of the exhaust flow passage to minimize the average steam pressure in the annulus just after the last row of turbine blades, to improve turbine efficiency under varying operating conditions.

In still another embodiment of the invention an adjustable guide vane assembly comprises one or more vanes associated with the outer surface of the bearing cone for at least a portion of the 360° circumference about the turbine shaft axis. In the portion of the bearing cone having the adjustable guide vane assembly, the vane or vanes can be pivoted to move to varying degrees or supported in a manner to move axially parallel to the turbine longitudinal axis to change the cross-sectional area of the exhaust flow passage so as to lower the average steam pressure after the last row of turbine blades and thus improve turbine efficiency under varying operating conditions.

BRIEF DESCRIPTION OF THE DRAWINGS

The nature of the invention will be more clearly understood by reference to the following description, the appended claims and the several views illustrated in the accompanying drawings

DETAILED DESCRIPTION OF THE INVENTION

Figure 2:
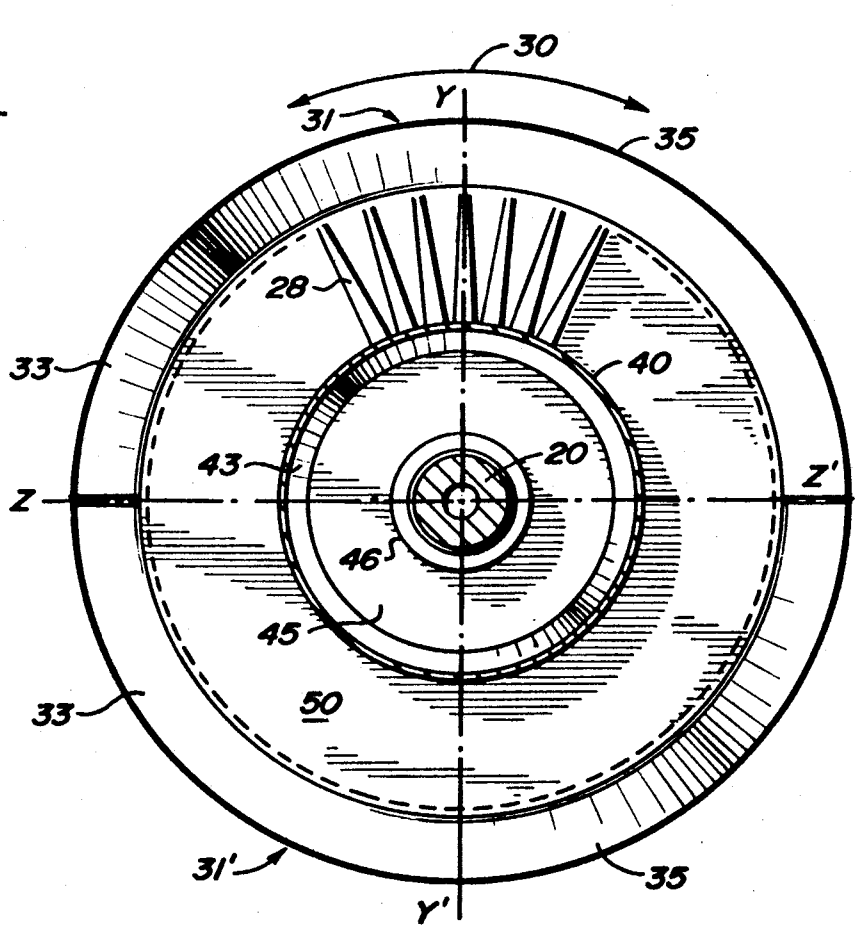
FIG. 2 PRIOR ART
FIG. 2 is a transverse sectional view taken along the line 2—2 of FIG. 1 illustrating a cross-section of the exhaust flow passage, as defined by the outer surface of the bearing cone and the inner surface of the fixed guide vane.
Figure 1:
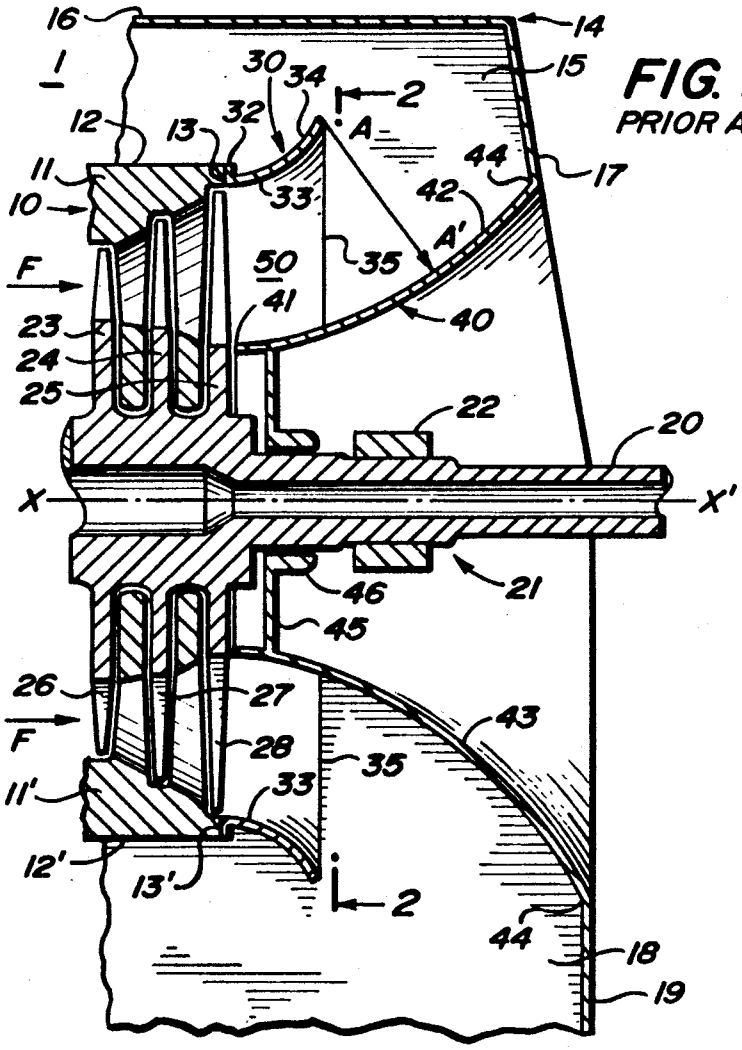
FIG. 1 PRIOR ART
FIG. 1 is a schematic, longitudinal, sectional view of an end portion of a multi-stage, axial-flow condensing steam turbine showing the turbine low pressure exhaust end, including the bearing cone and downwardly-discharging exhaust hood, and illustrating the prior art exhaust flow passage, defined by the outer surface of the bearing cone and inner surface of the fixed guide vane, for steam leaving the final turbine stage.

In FIGS. 1 and 2 there is shown a portion of an exhaust end of a multi-stage, axial-flow condensing steam turbine 1 having a casing 10 with top 11 and bottom 11'. Casing top 11 has top outer surface 12 and exhaust end surface 13. Casing bottom 11' has bottom outer surface 12' and exhaust end surface 13'. Surrounding the end of casing is exhaust hood 14, which has a top portion 15, with top wall 16, and top portion end plate 17, and bottom portion 18, with bottom outer end plate 19. Exhaust hood bottom portion 18 connects with a condenser, not shown.

Extending through turbine casing 10 and exhaust hood 14 is turbine shaft 20 having central longitudinal axis X-X' and outer portion 21 mounted on bearing 22. Attached to turbine shaft 20, at spaced intervals, are turbine disks 23, 24 and 25 and fastened to each such disk is turbine blade row 26, 27 and 28, respectively.

As shown in FIGS. 1 and 2, fixed guide vane assembly 30 extends outwardly from exhaust end surfaces 13 and 13' of turbine casing 10 and for 360° circumferentially about shaft longitudinal axis X-X' into exhaust hood 14 and comprises top vane portion 31 and bottom vane portion 31'. Each such vane portion extends 180° about axis X-X', is identical in design and includes an inner flanged end 32, inner surface 33, outer surface 34 and outer end 35. Flanged end 32 of each of vane portions 31 and 31', respectively, is fastened by bolts or recessed machine screws, not shown, to end surfaces 13 and 13' respectively, of turbine casing top 11 and bottom 11' respectively.

Extending from adjacent turbine disk 25 is bearing cone 40 which has the shape of a truncated cone and which surrounds turbine shaft outer portion 21 and bearing 22. Bearing cone 40 has inner end 41, curved outer surface 42, inner surface 43 and outer end 44, which connects with exhaust hood top and bottom portion end plates 17 and 19, respectively. Bearing cone inner end plate 45 extends from cone inner surface 43, adjacent cone inner end 41, toward turbine shaft 20 Mounted centrally of bearing cone inner end plate 45 is shaft seal 46 which acts to prevent the flow of air into exhaust hood 14 along turbine shaft 20

Immediately following turbine blade row 28 is exhaust flow passage 50, which is bounded by bearing cone outer surface 42 that acts as the exhaust flow passage inner wall and fixed guide vane inner surface 33 that acts as the exhaust flow passage outer wall. Along the fixed guide vane assembly 30, exhaust flow passage 50 extends from the exit of turbine blade row 28 to fixed guide vane outer end 35. For purposes of this invention, the exit of the exhaust flow passage 50 is defined by the line extending from fixed guide vane outer end 35 perpendicularly to bearing cone outer surface 42, which is the pertinent height of the exit designated by line A-A' in FIG. 1. The height of the exit of the exhaust flow passage 50 as designated by line A-A' is the same for 360°.

The design of the fixed guide vane assembly 30 and bearing cone 40, which are symmetrical about turbine shaft longitudinal axis X-X', are conventional for multi-stage, axial-flow steam turbines currently in operation.

Steam flows from left to right as indicated by arrows F in FIG. 1, through turbine casing 10, turbine blade rows 26, 27 and 28, respectively, to hood top and bottom portions 15 and 18, respectively, and then downwardly to a condenser, not shown.

Figure 3:
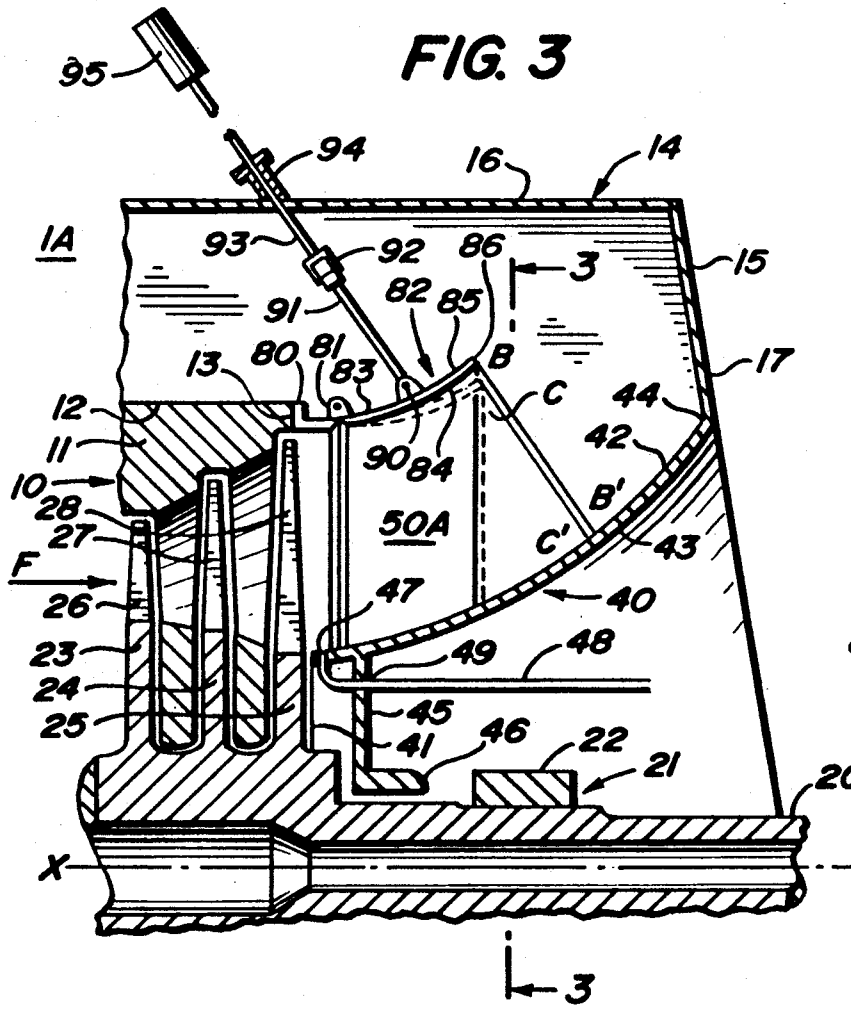
FIG. 3 is an enlarged schematic longitudinal sectional view of a top-end portion of a multi-stage, axial-flow, condensing steam turbine corresponding to that of FIG. 1 and illustrating the exhaust flow passage, as defined by the outer surface of the bearing cone and inner surface of an adjustable guide vane assembly of the present invention.

Referring to FIG. 3, there is shown a top portion of the exhaust end of a multi-stage, axial-flow condensing steam turbine 1A having a design comparable to, and elements common with, turbine 1 of FIG. 1 and incorporating the preferred embodiment of this invention. Where elements in FIG. 3 are applicable to those of FIG. 1, common reference numerals have been employed.

Turbine 1A has casing 10 with top 11. Casing top 11 has outer surface 12 and exhaust end surface 13. Exhaust hood 14 surrounds the end of casing 11 and has top portion 15 with top wall 16 and end plate 17. Turbine 1A has turbine shaft 20 with longitudinal axis X-X' and outer portion 21 mounted on bearing 22. Attached to turbine shaft 20, at spaced intervals, are turbine disks 23, 24 and 25, and fastened to each such disk is turbine blade row 26, 27 and 28, respectively.

Extending outwardly of turbine 1A from adjacent turbine disk 25 is bearing cone 40, which has the shape of a truncated cone and surrounds turbine shaft outer portion 21 and bearing 22. Bearing cone 40 has inner end 41, curved outer surface 42, inner surface 43 and outer end 44, which connects with exhaust hood outer end plate 17. Bearing cone inner end plate 45 extends from cone inner surface 43 adjacent inner end 41, toward bearing shaft 20. Mounted centrally of bearing cone inner end plate 45 is shaft seal 46.

Figure 4:
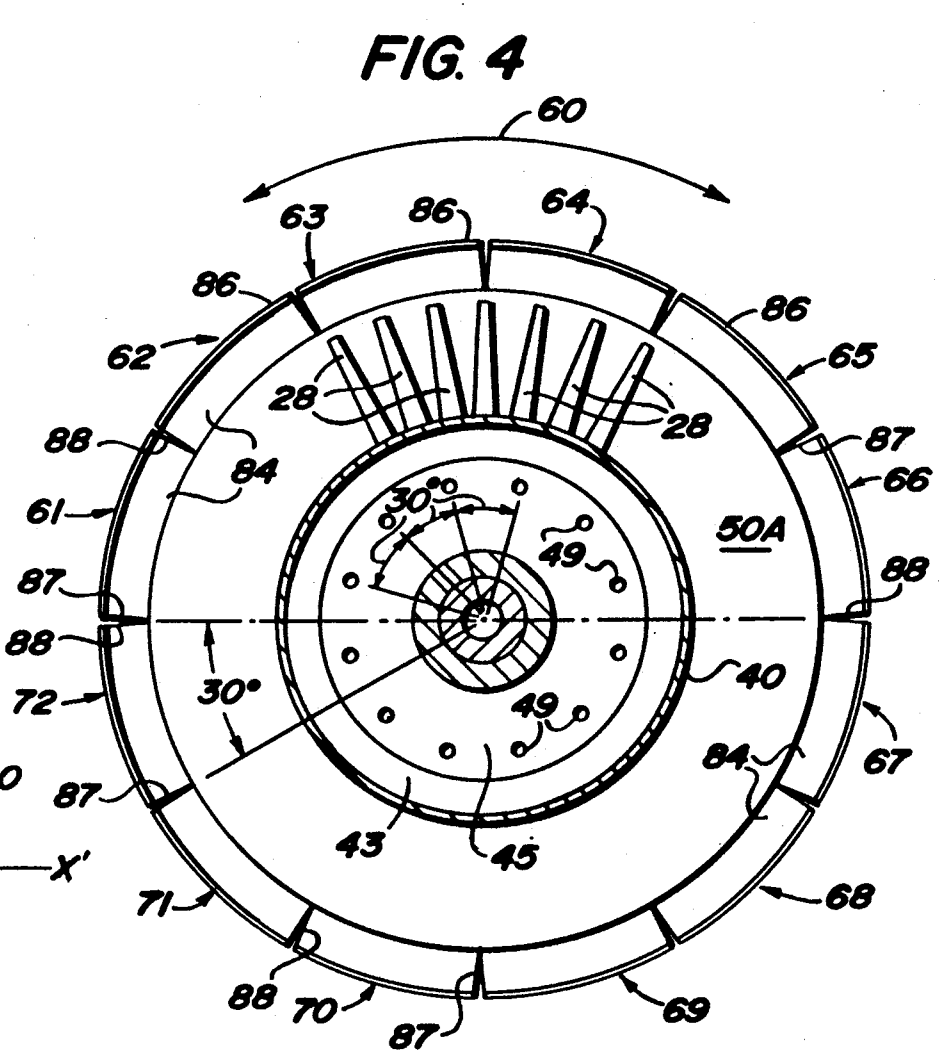
FIG. 4 is a sectional view taken along the line 3—3 of FIG. 2 extended for the full transverse section of the turbine of FIG. 3 and illustrating a cross-section of the exhaust flow passage, as defined by the outer surface of the bearing cone and the inner surface of the adjustable guide vane assembly of the present invention extended 360° circumferentially of the turbine shaft longitudinal axis.

The preferred embodiment of this invention comprises outer adjustable guide vane assembly 60, as shown in FIG. 4, which extends outwardly from casing 10 and for 360° circumferentially about shaft axis X-X' into exhaust hood 14. Outer adjustable guide vane assembly 60 comprises 12 segments, 61, 62, 63, 64, 65 and 66 in the top half of the casing and segments 67, 68, 69, 70, 71 and 72 in the bottom half of the casing. Each such segment extends through an arc of about 30°, is similar in design and includes inner flange portion 80, hinge 81 and adjustable vane 82. Vane 82 includes hinge end 83, inner surface 84, outer surface 85, outer end 86, edge 87 and edge 88. Connected to vane outer surface 85 at bracket 90 is inner control rod 91 which is joined by joint 92 to outer control rod 93 that extends through seal assembly 94 in hood top wall 16. Control rods 91 and 93, are operated by an appropriate drive unit 95 connected to the outer end of outer control rod 93. Drive unit 95 may be controlled electrically, hydraulically, mechanically or pneumatically to cause the movement of adjustable vane 82 about hinge 81 so that outer end 86 is moved, as applicable, farther from or closer to bearing cone outer surface 42.

Immediately following turbine blade row 28 is exhaust flow passage 50A, which is bounded by bearing cone outer surface 42 that acts as the flow passage inner wall and by outer adjustable guide vane assembly vane inner surface 84 that acts predominantly as the flow passage outer wall. With the adjustable vanes 82 of guide vane assembly segments 61–72 in the position shown by solid lines in FIG. 3, inner surface 84 of each vane 82 defines with outer surface 42 of bearing cone 40 a flow passage which has a height at its exit designated by the line B-B'. With the adjustable vane 82 of such guide vane in the position shown by the phantom lines, outer end 86, which is moved closer to outer surface 42 of bearing cone 40, defines with its outer surface 42, an exhaust flow passage which has a height at its exist designated by line C-C'. The exit height of the flow passage designated by line C-C' is smaller than that designated by the line B-B'.

As shown in FIG. 3, inner flange portions 80 of outer adjustable guide vane assembly segments 61–72, are firmly fastened to casing outer end surface 13, and to surface 13', not shown, by bolts or recessed machine screws, not shown, with edge 87 of one segment alongside edge 88 of an adjacent segment as shown in FIG. 4. The adjustable vanes 82 of segments 61–72 of adjustable guide vane assembly 60, because they pivot about hinges 81, are made with a clearance between edge 87 of one segment and edge 88 of an adjacent segment. The clearance is nominal at vane inner hinge ends 83 and greater at outer ends 86 so that the edge of one segment does not contact the edge of an adjacent segment and cause interference with movement.

As shown in FIG. 3 and 4, twelve small orifices or pressure taps 47 in the bearing cone 40, adjacent cone inner end 41, connect with tubes 48 which pass through bearing cone inner end plate holes 49. Tubes 48 extend through the interior of bearing cone 40 to pressure measuring instruments, not shown, which determine the exhaust steam pressure in flow passage 50A in the vicinity of each orifice 47. There is one orifice 47 for each segment of the outer adjustable guide vane assembly 60 and orifices 47 are spaced about 30° apart in a plane through each such orifice, as shown best in FIG. 4 which illustrates the location of holes 49 which have the same 30° spacing The preferred embodiment of the invention described above is particularly suited for retrofitting to existing turbines during time periods when such turbines are taken out of service for periodic maintenance. The fixed guide vane of a turbine can be easily removed from the turbine top and bottom casings, or merely the top casing, and the designated number of outer adjustable guide vane segments of assembly 60 secured to the casing or casings. In similar fashion the vane control elements, i.e. control rod 91, joint 92, control rod 93 and seal 94, can be installed at the same time and connected with an appropriate drive system, not shown, located outside of exhaust hood top wall 16, which controls the movements of the vanes 82 about hinge 81. Movement of the outer end 86 of a vane 82 changes the cross sectional area of exhaust flow passage 50A at the location of such vane which results in a changed pressure at the exit of the last row of turbine blades 28. By measuring the pressure at orifices 47, adjacent the last row of turbine blades 28, and moving one or more of the adjustable vanes 82 to decrease such pressure, as desired, the turbine may be operated at optimum efficiency under varying conditions.

ALTERNATIVE EMBODIMENTS

Figure 5:
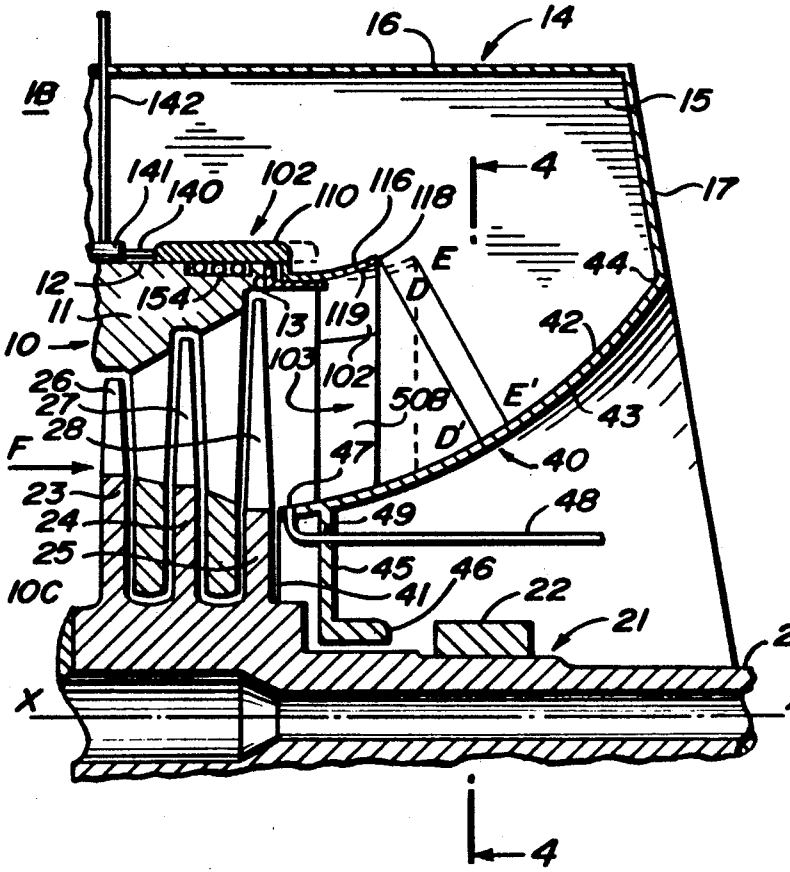
FIG. 5 is an enlarged, schematic, longitudinal sectional view of a top-end portion of a multi-stage, axial-flow, condensing steam turbine corresponding to that of FIG. 1 and illustrating the exhaust flow passage, as defined by the outer surface of the bearing cone and the inner surface of an alternative embodiment of the adjustable guide vane assembly of the present invention.
Figure 7:
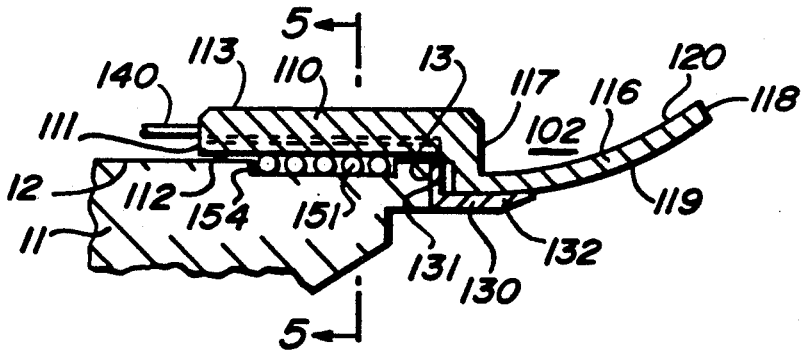
FIG. 7 is an enlarged fragmentary, sectional view of the alternative embodiment of the adjustable guide vane assembly mounted in the upper portion of the turbine of FIG. 5.

Referring to FIG. 5 there is shown a top portion of an exhaust end of a multi-stage, axial-flow condensing steam turbine 1B, which incorporates a first alternative embodiment of this invention. Turbine 1B has a design similar to, and elements common with, those of turbines 1 and 1A of FIGS. 1 and 3, respectively, and where elements in FIG. 5 are applicable to those of turbine 1 of FIG. 1, common reference numerals have been employed.

Turbine 1B has casing 10 with top 11, which has outer surface 12 and exhaust end surface 13. Exhaust hood 14 surrounds the end of casing 10 and has top portion 15 with top wall 16 and end plate 17. Turbine 1B has turbine shaft 20 which has longitudinal axis X-X' and outer portion 21 mounted on bearing 22. Attached to turbine shaft 20, at spaced intervals, are turbine disks 23, 24 and 25 and fastened to each such disk is turbine blade row 26, 27 and 28, respectively.

Extending outwardly from adjacent turbine disk 25 is bearing cone 40, which has the shape of a truncated cone and surrounds turbine shaft outer portion 21 and bearing 22. Bearing cone 40 has inner end 41, curved outer surface 42, inner surface 43 and outer end 44, which connects with exhaust hood end plate 17. Bearing cone inner end plate 45 extends from cone inner surface 43, adjacent inner end 41, toward bearing shaft 20. Mounted centrally of bearing cone inner end plate 45 is shaft seal 46.

The first alternative embodiment of this invention, best shown in FIGS. 5–10, comprises outer adjustable guide vane assembly 100, which extends outwardly from casing 10 for 360° circumferentially of turbine shaft axis X-X' into exhaust hood 14. Guide vane assembly 100 comprises segments 101, 102 and 103 associated for 180° with casing top 11, bearings 150, 151 and 152, respectively, and a guide member 130 for each such segment. Guide vane assembly 100 further comprises segments 104, 105 and 106. Each such segment extends in an arc of about 60°.

Referring to FIGS. 5–10, each of outer adjustable guide vane assembly segments 101–106 is similar in design and includes body 110, vane 116 and edges 121 and 122. Body 110 includes inner end 111, inner surface 112, outer surface 113 and T-shaped slots 114 and 115 which extend from body inner end 111 partially through body 110. The stem portions, unnumbered, of T-slots 114 and 115 extend from body inner surface 112 into body 110 and the top bar portions, unnumbered, extend within body 110 perpendicular to the stem portions and generally parallel to body inner surface 112. Vane 116 includes inner flanged end 117 that connects with body portion 110, outer end 118, inner surface 119 and outer surface 120. Associated with each guide vane assembly segment is inner guide member 130 which includes flanged end 131 and leg 132. Connected to body inner end 111 of each of segments 101-106 is rod 140 which extends from drive unit 141 that in turn is connected by line 142 to a control system, not shown.

As best shown in FIGS. 5–8, outer adjustable guide assembly segments 101, 102, and 103 move reciprocably along turbine casing top 11 and axially of turbine 1B. The inner surface 112 of body 110 of each of segments 101, 102 and 103 moves adjacent turbine casing top outer surface 12 on three identical anti-friction bearing elements 150, 151 and 152, respectively, which are recessed within pockets 153, 154 and 155, respectively, of turbine casing top outer surface 12. Each of pockets 153, 154 and 155 is machined to permit each of bearing elements 150, 151 and 152, respectively, to be seated firmly in its pocket while the top of each bearing element projects a short distance above turbine casing top outer surface 12 so that the body inner surface 112 of each of segments 101, 102 and 103 can be moved axially by its associated drive unit 141 and rod 140 in a manner to avoid contact and friction between segment body inner surface 112 and turbine casing top outer surface 12.

Figure 6:
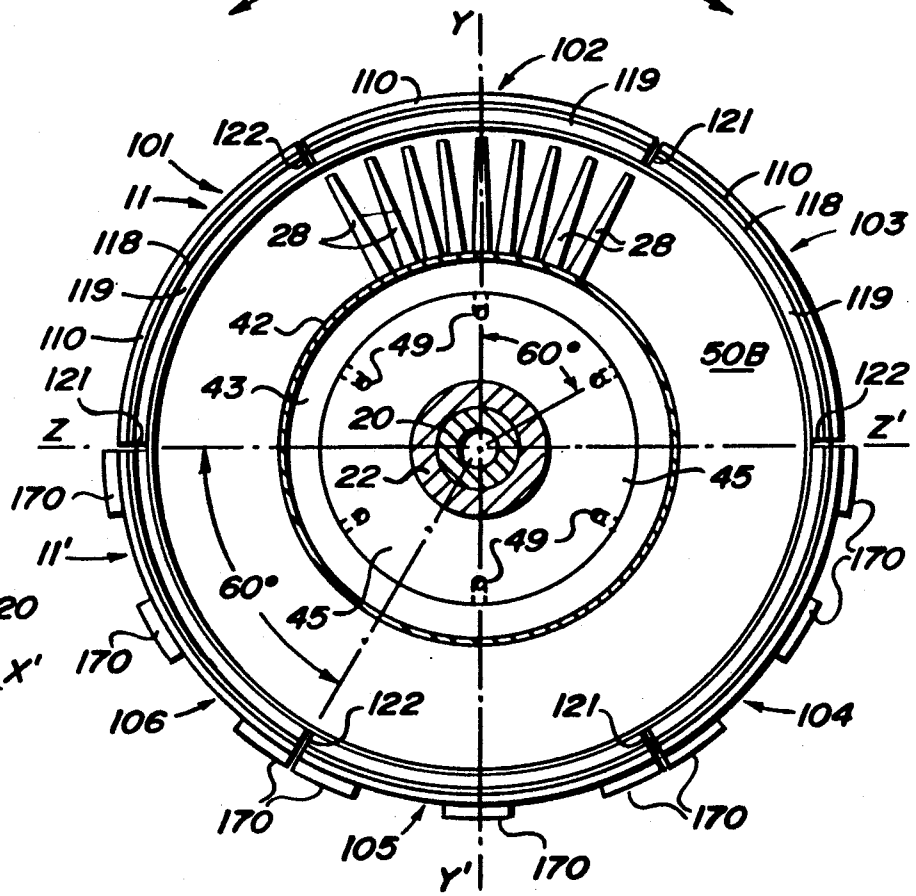
FIG. 6 is a sectional view taken along the line 4—4 of FIG. 5 extended for the full transverse section of the turbine of FIG. 5 and illustrating a cross-section of the exhaust flow passage, as defined by the outer surface of the bearing cone and the inner surface of an alternative embodiment of the adjustable guide vane assembly of the present invention.
Figure 8:
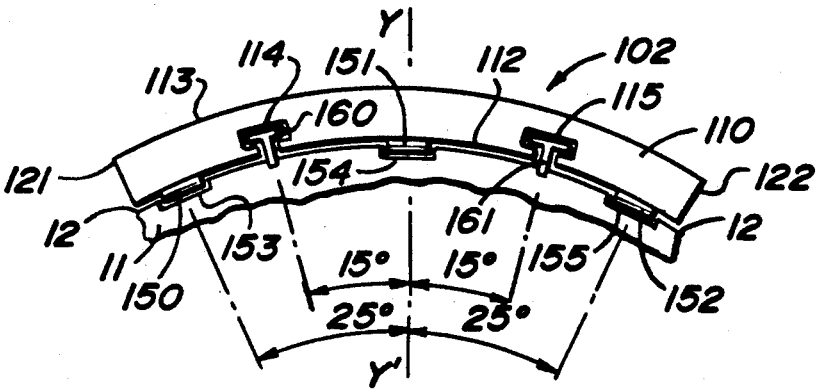
FIG. 8 is a sectional view taken along the line 5—5 of FIG. 7.

As shown in FIGS. 6 and 8, T-shaped slots 114 and 115 of segment 102 are positioned 15° from plane Y-Y' which extends vertically through turbine shaft axis X-X' longitudinally of turbine 1B and through the center of the arcs of segments 102 and 105. Cooperatively associated with slots 114 and 115 are T-bars 160 and 161, respectively. Each such T-bar has its base secured to turbine casing top outer surface 12 in a manner well known to those skilled in the art, as by welding. The center of bearing pocket 154 of segment 102 is positioned in turbine casing top outer surface 12 with its center extending along the plane Y-Y' and is spaced from turbine casing top outer end surface 13. Bearing pockets 153 and 155, respectively, are spaced about 25° on opposite sides of such plane and spaced from segment edges 121 and 122, respectively. Segments 101 and 103 are of similar construction, as are the T-bars, bearings and bearing pockets of associated portions of turbine casing top 11, and the reference numerals applicable thereto are common to those used here above for segment 102. As segments 101, 102 and 103 move axially the vane portion inner surface 119 of each such segment is supported adjacent vane flange end 117 by inner guide member leg 132.

Outer adjustable guide assembly segments 104, 105 and 106 are moved reciprocably of turbine casing bottom 11' by means of rods 140, not shown, connected to drive units 141, not shown, in a manner similar to that described above for segments 101, 102 and 103. However, on turbine casing bottom 11', the manner of supporting segments 104, 105 and 106 is different than that described above for segments 101, 102 and 103 on turbine casing top 11, even though the design of all such segments, including use of T-bars 160 and 161, is similar.

Figure 9:
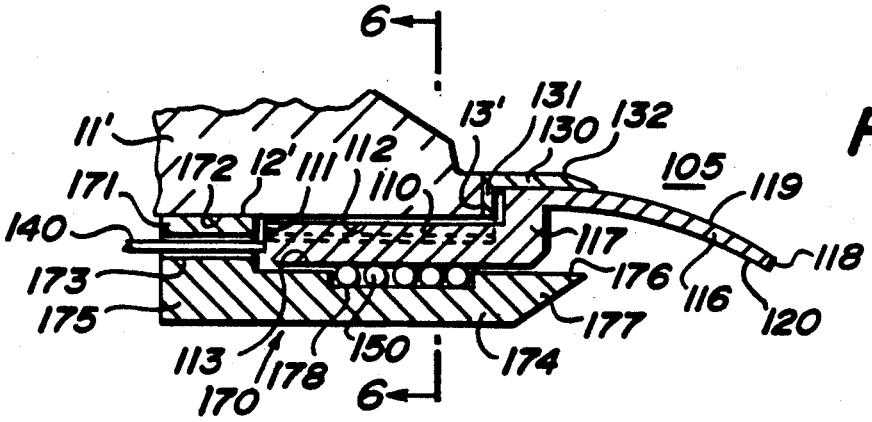
FIG. 9 is an enlarged fragmentary, sectional view of the alternative embodiment of the adjustable guide vane mounted in the lower portion of the turbine illustrated in section in FIG. 6.
Figure 10:
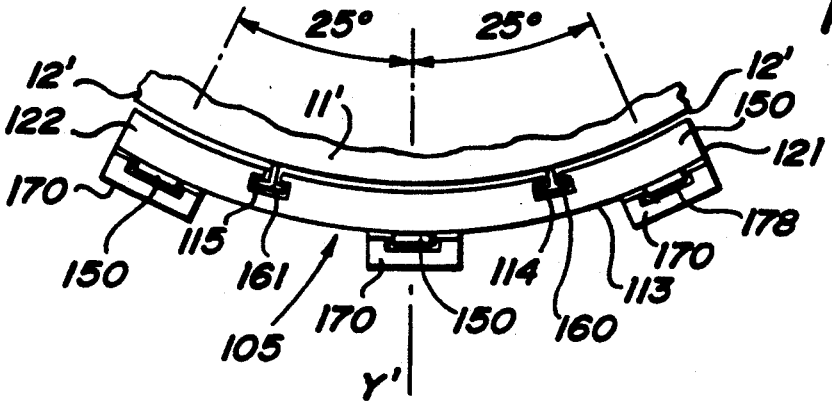
FIG. 10 is a sectional view taken along the lines 6—6 of FIG. 9.

As best shown in FIGS. 6, 9 and 10, segment 105 is supported by means of three identical outer support brackets 170. Each bracket 170 includes base section 171 and elongated support member 174. Base section 171 has surface 172, which abuts turbine casing bottom outer surface 12', and hole 173, which extends through base section 171 parallel to turbine shaft axis X-X' and through which rod 140 extends from drive unit 141, not shown, and connects with segment body inner end 111. Support member 174 includes inner end 175, which is joined to base section 171, inner surface 176 and outer end 177. Each support bracket 170 is connected to turbine casing bottom outer surface 12' in a manner known to those skilled in the art, as by countersunk machine screws, not shown, which extend through base section 171 into turbine casing bottom 11'.

Mounted within pocket 178 of inner surface 176 of each support bracket support member 174 is anti-friction bearing element 150. Bearing element 150 is identical to those used in conjunction with adjustable guide assembly segments 101, 102 and 103. Each of bearing elements 150 is seated firmly in its associated pocket 178 so that the top of such bearing element projects a short distance above inner surface 176 of support bracket support member 174 so that the outer surface 113 of body portion 110 of guide vane assembly segment 105 can be moved on the bearing axially by the vane assembly associated drive unit 141, not shown, and rod 140. Such movement takes place without contact between outer surface 113 of body portion 110 of outer adjustable guide vane assembly segment 105 and inner surface 176 of support bracket member 174. One bracket 170 is positioned in the center of guide vane assembly segment 105 and one is positioned adjacent each of segment edges 121 and 122, respectively. Each bearing element 150 is centered in each bracket support member 174 so that the bearing element is positioned radially and parallel to turbine shaft axis X-X' in the same manner as the bearing elements 150 of segments 101, 102 and 103. As segments 104, 105 and 106 move axially or longitudinally of turbine 1B, the vane inner surface 119 of each segment is guided adjacent vane flanged end 117 by inner guide member leg 132.

As shown in FIG. 5, immediately following turbine row 28 is exhaust flow passage 50B, which is bounded by bearing cone outer surface 42 that acts as the flow passage inner wall and by outer adjustable guide vane inner surface 119 that acts predominately as the flow passage outer wall for each of segments 101–106. With an adjustable guide vane assembly segment, for example segment 102, in the position shown by the solid lines in FIG. 5, inner surface 119 of each vane 116 defines with outer surface 42 of bearing cone 40 an exhaust flow passage which has a height at its exit designated by line D-D'. With the vane 116 of such segments in the position shown by phantom lines, inner surface 119 of each vane 116 which is moved closer to outer surface 42 of bearing cone 40, defines with outer surface 42 of bearing cone 40 an exhaust flow passage which has a height at its exit designated by line E-E'. The exit height of the exhaust flow passage designated by the line E-E' is smaller than that designated by the line D-D'.

As shown in FIGS. 5 and 6, six orifices or pressure taps 47 in bearing cone 40, adjacent inner end 41, connect with tubes 48 which pass through bearing cone inner end plate holes 49. Tubes 48 extend through the interior of bearing cone 40 to pressure measuring instruments, not shown, which determine the exhaust steam pressure in flow passage 50B in the vicinity of each orifice 47. There is one orifice 47 for each segment of the outer adjustable guide vane assembly 100 and orifices 47 are spaced about 60° apart in a plane through each such orifice and axis X-X', as best shown in FIG. 6.

The first alternative embodiment of the invention described above is particularly suited for incorporation in new turbines. The outer surface of the end of the turbine casing can be machined during the manufacturing stages for the bearing pockets to receive the outer support bracket base bottom surfaces 172 and for drive units 141. The number of segments in outer adjustable guide vane assembly 100 is a function of the degree of control the turbine operators plan to have over the cross-sectional area of exhaust flow passage 50B. The segments can be positioned 360° about the turbine axis X-X' as shown in FIG. 6 or only in the top 180° of turbine casing top 11. Each segment moves axially or longitudinally of turbine 1B, alone or in combination with one or more other segments, to modify or change the cross-sectional area of exhaust flow passage 50B. By measuring the pressure at orifices 47 adjacent the last row of turbine blades 28 and moving one or more of the adjustable vanes 101–106 to lower such pressure, the turbine may be operated at optimum efficiency under varying conditions.

The first alternative embodiment of the invention described above has vane assembly segments 101–106 of identical design, with segments 101, 102 and 103 supported in one manner on turbine casing top 11 and segments 104, 105 and 106 supported somewhat differently on turbine casing bottom 11'. It may be desirable to have guide vane segments 101, 103, 104 and 106, which do not lie in the vertical plane Y-Y' passing through shaft X-X, designed somewhat differently than described above so that the bearing elements supporting such segments, for example, are placed horizontally.

Figure 11:
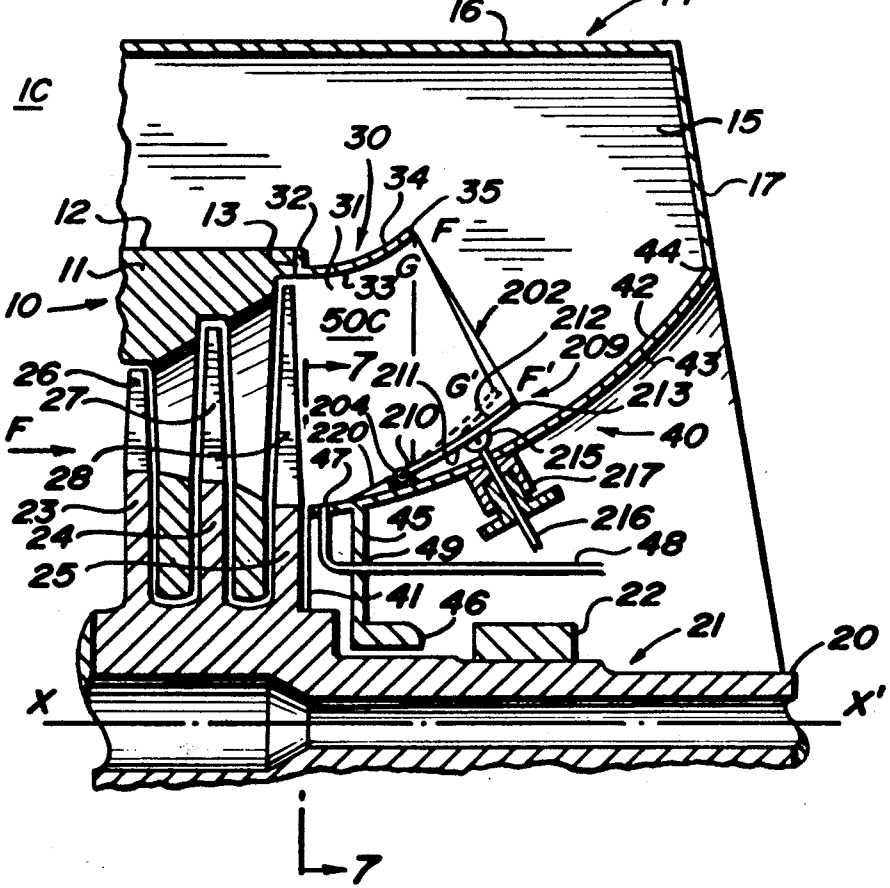
FIG. 11 is an enlarged schematic, longitudinal, sectional view of a top-end portion of a multi-stage, axial-flow, condensing steam turbine corresponding to that of FIG. 1 and illustrating the exhaust flow passage, as defined by the inner surface of the fixed guide vane and the outer surface of an alternative embodiment of the adjustable guide vane assembly of the present invention mounted in a pivotal manner on the outer surface of the turbine bearing cone.

Referring to FIG. 11 there is shown a top portion of the exhaust end of a multi-stage, axial-flow condensing steam turbine 1C having a design comparable to, and elements common with, those of turbines 1, 1A and 1B of FIGS. 1, 3 and 5, respectively, and incorporating a second alternative embodiment of this invention. Where elements in FIG. 11 are applicable to those of FIGS. 1, 3 and 5, common reference numerals have been employed.

Turbine 1C has casing 10 with top 11, which has outer surface 12 and exhaust end surface 13. Exhaust hood 14 surrounds the end of casing 10 and has top portion 15 with top wall 16 and outer end plate 17. Turbine 1C has turbine shaft 20 which has central longitudinal axis X-X' and outer portion 21 mounted on bearing 22. Attached to turbine shaft 20 at spaced intervals are turbine disks 23, 24 and 25, respectively, and fastened to each such disk is turbine blade row 26, 27 and 28, respectively.

Extending outwardly from adjacent turbine disk 25 is bearing cone 40 which has the shape of a truncated cone and surrounds turbine shaft outer portion 21 and bearing 22. Bearing cone 40 has inner end 41, curved outer surface 42, inner surface 43 and outer end 44, which connects with the exhaust hood end plate 17. Bearing cone inner end plate 45 extends from inner surface 43, adjacent cone inner end 41, toward bearing shaft 20. Mounted centrally of bearing cone inner end plate 45 is shaft seal 46.

Fixed guide vane assembly 30 extends, circumferentially outwardly in the form of a circle, as shown in FIG. 2, from turbine casing 10 into exhaust hood 14 and comprises segments 31, and 31', not shown, respectively. Each such segment is identical in design and includes an inner flanged end 32, inner surface 33, outer surface 34 and outer end 35. Flanged end 32 of segment 31 is fastened by bolts, not shown, to end surface 13 of turbine casing top 11. The flanged end 32 of segment 31', not shown, is fastened in a similar fashion to end surface 13' of turbine casing bottom portion 11'.

Figure 12:
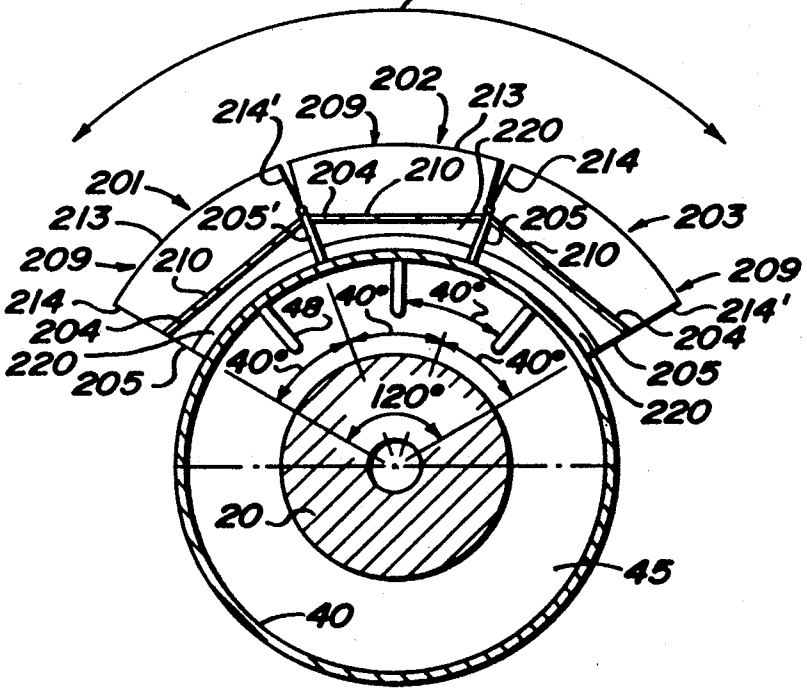
FIG. 12 is a transverse sectional view taken along the line 7—7 of FIG. 11.

The second alternative embodiment of this invention, best shown in FIGS. 11 and 12, comprises inner adjustable guide vane assembly 200 having three segments 201, 202 and 203 which are mounted on the outer surface 42 of bearing cone 40. Each segment extends for 40°, circumferentially of cone 40 for a total of 120° for the three segments, transversely of the longitudinal axis X-X' of turbine 1C. Each such segment is similar in design and includes inner end hinge-piece 204 and outer adjustable vane 209. As best shown in FIG. 12, inner end hinge-piece 204 has edges 205 and 205' and is secured at its bottom, not identified, as by welding, to cone outer surface 42. Outer adjustable vane 209 has inner hinge portion 210, inner surface 211, outer surface 212, outer end 213 and edges 214 and 214'. Adjustable vane inner hinge portion 210 is pivotally fastened to segment inner end hinge-piece 204. Connected to adjustable vane inner surface 211 by bracket 215 is control rod 216 which extends through control rod seal 217 through bearing cone 40 to the interior thereof and connects with a hydraulic system, not shown, which operates to move control rod 216 to cause outer adjustable vane 209 to pivot about segment inner end hinge-piece 204 so that vane outer end 213 is moved farther from or closer to fixed guide vane inner surface 33. Mounted on the turbine side of each of segments 201, 202 and 203 is member 220. Each member 220 is generally wedge shaped in section, not identified, on a plane extending longitudinally through axis X-X', with a thin front end and a back end having a height, not identified, about equal to that of inner end hinge-piece 204 of each of segments 201, 202 and 203.

As shown in FIG. 11, immediately following turbine blade row 28 is exhaust flow passage 50C. In the portion of the bearing cone 40 on which adjustable guide wave assembly 200 is mounted, flow passage 50C is bounded by fixed guide vane inner surface 33, which acts as the flow passage outer wall, by the surfaces of members 220 and by the outer surfaces 212 of adjustable vanes 209 of segments 201, 202 and 203, respectively, all of which act predominantly as the flow passage inner wall. With the adjustable vanes 209 of inner guide vane assembly 200 in the position shown by solid lines in FIG. 11, outer surface 212 of each vane 209 defines with inner surface 33 of fixed guide vane 30 an exhaust flow passage which has a height at its exit designated by the line F-F'. With the adjustable vanes 209 of inner guide vane assembly 200 in the position shown by phantom lines, outer surface 212 of each vane 209, which is moved closer to inner surface 33 of fixed guide vane 30, defines with inner surface 33 an exhaust flow passage which has a height at its exit designated by line G-G'. The exit height of the exhaust flow passage designated by the line G-G' is smaller than that designated by the line F-F'.

As shown in FIGS. 11 and 12 three orifices 47 in bearing cone 40, adjacent inner end 41, connect with tubes 48 which pass through bearing cone inner end plate holes 49. Tubes 48 extend through the interior of bearing cone 40 to pressure measuring instruments, not shown, which determine the exhaust steam pressure in flow passage 50C in the vicinity of each orifice 47. There may be one orifice 47 for each segment of the outer adjustable guide vane assembly 200 and orifices 47 are spaced about 40° apart, as best shown in FIG. 12. Additional orifices may be placed in bearing cone 40 to monitor the pressure at more locations around the bearing cone.

The second alternative embodiment of the invention described above is particularly suited for retrofitting to existing turbines during time periods when such turbines are taken out of service for periodic maintenance. The fixed guide vane assembly 30 requires no change. Only members 220 and adjustable guide vane assembly 200, with properly designed segments 201, 202 and 203, must be installed on the outer surface 42 of bearing cone 40, together with associated control rods 216, seals 217, connections to applicable drive systems, not shown, and orifices 47 with connecting tubes 48.

Movement of the outer end 213 of one or more vanes 209 toward or away from the fixed guide vane inner surface 33 changes the cross-sectional area of exhaust flow passage 50C at each such vane, so as to produce, at certain vane positions, the lowest average pressure at the exit of the last row of turbine blades 28. By measuring the pressure at orifices 47, adjacent the last row of turbine blades, and moving one or more adjustable vanes 209 to modify such pressure, as desired, the turbine may be operated at optimum efficiency under varying conditions.

Figure 13:
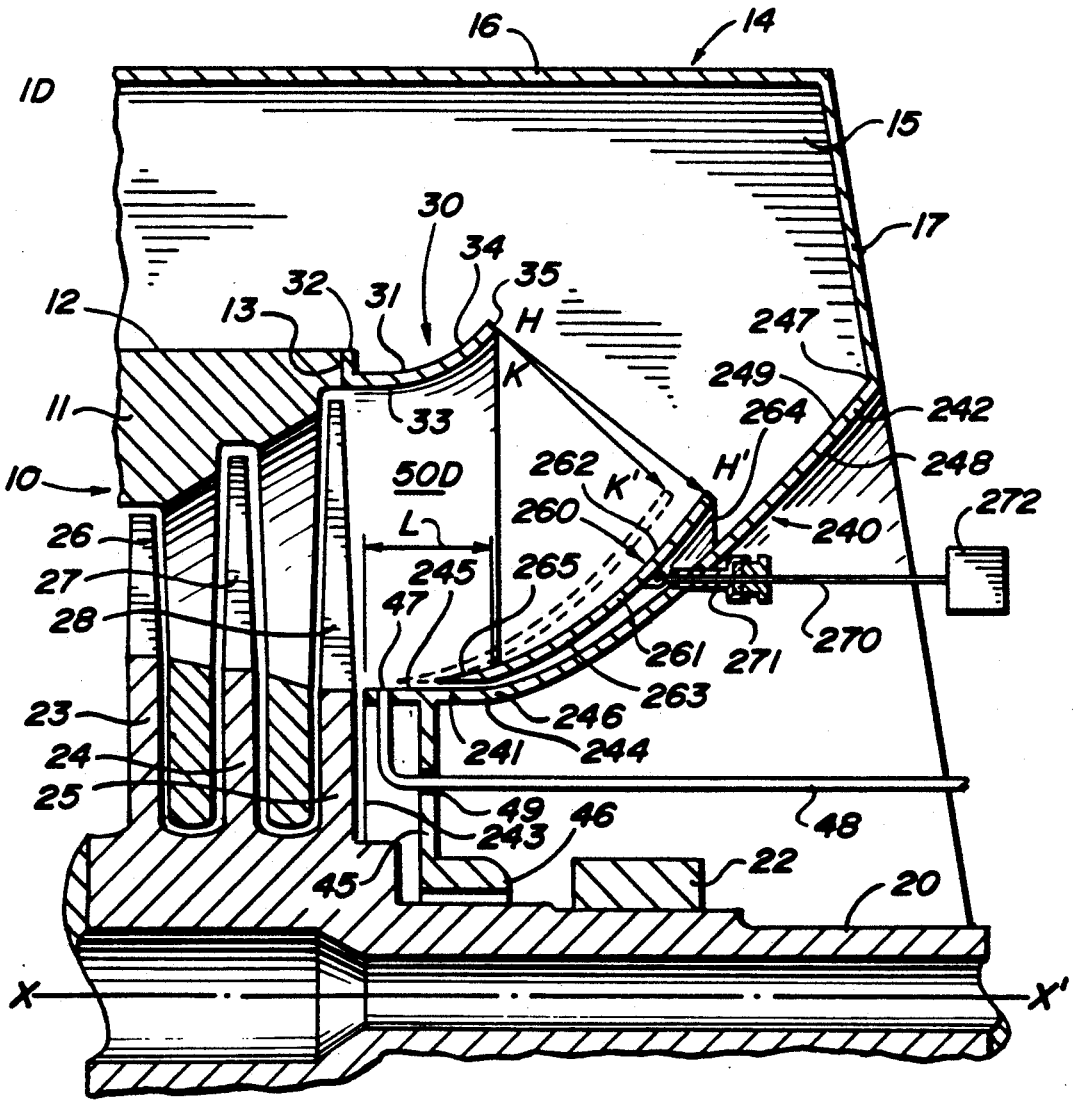
FIG. 13 is an enlarged schematic, longitudinal, sectional view of a top end portion of a multi-stage, axial-flow, condensing steam turbine corresponding to that of FIG. 1 and illustrating the exhaust flow passage, as defined by the inner surface of the fixed guide vane and the outer surface of still another alternative embodiment of the adjustable guide vane assembly of the present invention mounted in a manner to move axially and parallel to the turbine longitudinal axis.

Referring to FIG. 13 there is shown a top portion of the exhaust end of a multi-stage, axial-flow condensing steam turbine 1D having a design comparable to, and elements common with, those of turbines 1, 1A, 1B and 1C of FIGS. 1, 3, 5 and 11, respectively, and incorporating a third alternative embodiment of this invention. Where elements in FIG. 13 are applicable to those of FIGS. 1, 3, 5 and 11, common reference numerals have been employed.

Turbine 1D has casing 10 with top 11, which has outer surface 12 and exhaust end surface 13. Exhaust hood 14 surrounds the end of casing 10 and has top portion 15 with top wall 16 and outer end plate 17. Turbine 1D has turbine shaft 20 which has central longitudinal axis X-X' and outer portion 21 mounted on bearing 22. Attached to turbine shaft 20 are turbine disks 23, 24 and 25, respectively, and fastened to each such disk is turbine blade row 26, 27 and 28, respectively.

Extending from adjacent disk 25 is bearing cone 240, which has inner portion 241 in the shape of a cylinder and outer portion 242 in the shape of a truncated cone. Bearing cone inner portion 241 has inner end 243, outer end 244, outer surface 245 and length L. Bearing cone outer portion 242 has inner end 246 which connects with outer end 244 of bearing cone inner portion 241, outer end 247, which connects with exhaust hood outer plate 17, inner surface 248 and outer surface 249. Bearing cone inner end plate 45 extends from the inner surface of cone inner portion 241 adjacent its inner end 243, perpendicularly toward bearing shaft 20. Mounted centrally of the inner end of end plate bearing cone inner end plate 250 is shaft seal 46.

Fixed guide vane assembly 30 extends circumferentially outwardly for 360° as shown in FIGS. 1 and 2 from turbine casing 10 into exhaust hood 14 and comprises segments 31 and 31' which is not shown in FIG. 13. Each such segment is identical in design and includes, as shown in FIGS. 1 and 13, an inner flanged end 32, inner surface 33, outer surface 34 and outer end 35. Flanged end 32 is fastened by bolts, not shown, to turbine casing exhaust end surface 13. Flanged end 32 of segment 31', not shown, is fastened in a similar fashion to exhaust end surface 13' of turbine casing bottom portion 11'.

The third alternative embodiment of this invention shown in FIG. 13 comprises inner adjustable guide vane assembly 260 having adjustable vane 261. Vane 261 has outer surface 262, inner surface 263, outer end 264 and necked down or narrowed inner end 265. Secured to vane inner surface 263 is control rod 270 which extends parallel to turbine shaft longitudinal axis X-X' through control rod seal assembly 271 mounted in bearing cone 240. Control rod 270 connects with a vane positioning system 272, which controls the longitudinal, reciprocal movement of rod 270 and vane 261 connected thereto. Adjustable vane 261 extends for about 40° circumferentially of cone 240 and is narrower at its inner end 265 than at its outer end 264 which is at a greater distance from turbine longitudinal axis X-X' than is inner end 265 and partially surrounds bearing cone 240. Control rod 270 is secured to vane inner surface 260 at a location to balance the weight of the upper outer portion of vane 261 with the lower inner portion. This permits the unobstructed longitudinal movement of vane 261 with no support other than that of control rod 270 although vane inner end 265 may sometimes rest on bearing cone inner portion outer surface 245.

As shown in FIG. 13, immediately following turbine blade row 28 is exhaust flow passage 50D. In the portion of the turbine casing 10 in which adjustable guide vane assembly 260 is mounted, flow passage 50D is bounded by fixed guide vane inner surface 33, which acts as the flow passage outer wall and, depending on the position of adjustable vane 261, by the outer surface 245 of bearing cone inner portion 241 and outer surface 262 of vane 261, which act predominantly as the flow passage inner wall. With adjustable guide vane 261 in the position shown by solid lines in FIG. 13, outer surface 245 of bearing cone inner portion 241 and outer surface 262 of vane 261 define with inner surface 33 of fixed guide vane 30 an exhaust flow passage which has a height at its exit designated by the line H-H'. With the adjustable guide vane 261 in a forward position shown by phantom lines, outer surface 262 of vane 261 which is moved closer to inner surface 33 of fixed guide vane 30 defines with inner surface 33 an exhaust flow passage which has a height at its exit designated by line K-K'. The exit height of the exhaust flow passage designated by the line K-K' is smaller than that designated by the line H-H'.

As shown in FIG. 13, orifice 47 in bearing cone inner portion 241, adjacent inner end 243, connects with tube 48 which passes through bearing cone inner end plate hole 49. Tube 48 extends through the interior of bearing cone 240 to a pressure measuring instrument, not shown, which determines the exhaust steam pressure in flow passage 50D in the vicinity of orifice 47.

The third alternative embodiment of the invention described above is particularly suited for retrofitting to existing turbines during time periods when such turbines are taken out of service for periodic maintenance period. The fixed guide vane assembly 30 requires no change. A new bearing cone 240 must be substituted for the usual bearing cone 40 and an adjustable guide vane assembly 260 with vane 261 with associated control rod 270 and rod seal assembly 271 must be installed in a manner known to those skilled in the art.

Movement of the outer end 264 of vane 261 toward or away from the fixed guide vane inner surface 33 changes the cross-sectional area of exhaust flow passage 50D so as to produce, at certain vane positions, the lowest average pressure at the exit of the last row of turbine blades 28. By measuring the pressure at orifice 47, adjacent the last row of turbine blades and moving adjustable vane 261 to modify such pressure, as desired, the turbine may be operated at optimum efficiency under varying conditions.

The third alternative embodiment of the invention, i.e. adjustable guide vane assembly 260, has been shown with one vane 261 which extends circumferentially for about 40°. If desired, vane 261 may be enlarged circumferentially to cover 60° or more, even 360°, in which case the shape of the vane becomes that of a truncated cone. In that event it may be desirable to have two or more control rods 270 and associated seal elements 271 for the larger vane. In similar fashion, adjustable guide vane assembly 260 may include several vanes 261 each with its separate control rod or rods 270 and vane positioning system 272, which may be hydraulic, pneumatic, electrical or mechanical. In similar fashion, additional orifices and pressure taps 47 may be spaced circumferentially of bearing cone inner portion 241.

While the apparatus of this invention has been described above in a preferred manner and with several embodiments, the description has been simplified by avoiding reference to detailed features that are inherent in any steam turbine well known to those skilled in the art. It is further recognized that modifications and variations can be made by those skilled in the art to the above described invention and its several embodiments without departing from the spirit and scope thereof as defined by the appended claims.

I claim:

1. An adjustable vane system for use in a condensing steam turbine having a casing, a shaft extending longitudinally of said turbine, a plurality of rows of turbine blades mounted transversely of said turbine shaft, a bearing cone surrounding an outer portion of said shaft and having an outer surface, an exhaust flow passage, a fixed guide vane extending outwardly from said casing for at least a portion of the outer circumference thereof and forming at least a portion of the outer wall of said exhaust flow passage, comprising:

(A) movable vane means supported by said bearing cone, forming at least a portion of the inner wall of said exhaust flow passage; and (B) positioning means connected to said vane means for movement thereof to change the cross-sectional area of the exhaust flow passage to modify the pressure of steam adjacent the exit of the last row of turbine blades in response to varying operating conditions of said turbine.

2. The adjustable vane system of claim 1 further including:

(A) an orifice through said bearing cone adjacent the inner end thereof;

(B) a tube having:

(a) an inner end connecting with said orifice, and (b) an outer end; and (C) pressure measuring means connecting with the outer end of said tube for measuring the pressure of exhaust steam exiting the last row of turbine blades.

3. The adjustable vane system of claim 1 wherein there are a plurality of movable vane means supported by said bearing cone and a plurality of positioning means each connected to a movable vane means.

4. The adjustable vane system of claim 1 wherein said movable vane means are pivotally connected to the outer surface of said bearing cone and each said vane means has an outer end and a positioning means is connected to each said vane means to move the outer end thereof to change the cross-sectional area of the exhaust flow passage to modify the pressure of steam adjacent the exit of the last row of turbine blades in response to varying operating conditions of said turbine.

5. An adjustable vane system for use in a condensing steam turbine having a casing, a shaft extending longitudinally of said turbine, a plurality of rows of turbine blades mounted transversely of said turbine shaft, a bearing cone surrounding an outer portion of said shaft and having an outer surface, an exhaust flow passage, a fixed guide vane extending outwardly from said casing for at least a portion of the outer circumference thereof and forming at least a portion of the outer wall of said exhaust flow passage, comprising:

(A) a movable vane means forming at least a portion of the inner wall of said exhaust passage and having:

(a) an inner surface;

(B) positioning means connected to the inner surface of said movable vane means and extending through said bearing cone to move said vane means longitudinally of said turbine to change the cross-sectional area of the exhaust flow passage to modify the pressure of steam adjacent the exit of the last row of turbine blades in response to varying operating conditions of said turbine.

6. The adjustable vane system of claim 5 wherein there are a plurality of movable vane means forming at least a portion of the inner wall of said exhaust flow passage, each vane having an inner surface.

7. The adjustable vane system of claim 5 wherein the movable vane means is in the shape of a truncated cone and surrounds a portion of said bearing cone and there are positioning means attached to the inner surface of said movable vane means.

8. The adjustable vane system of claim 1 wherein the movable vane means comprises a plurality of segments.

9. An adjustable vane system for use in a condensing steam turbine having a casing, a shaft extending longitudinally of said turbine, a plurality of rows of turbine blades mounted transversely of said turbine shaft, a bearing cone surrounding an outer portion of said shaft and having an outer surface, comprising:

(A) a plurality of movable vane means supported by said bearing cone; and (B) positioning means connected to said vane means for movement thereof to modify the pressure of steam adjacent the exit of the last row of turbine blades in response to varying operating conditions of said turbine.

* * * * *

UNITED STATES PATENT AND TRADEMARK OFFICE

CERTIFICATE OF CORRECTION

PATENT NO. : 5,209,634

DATED : May 11, 1993

INVENTOR(S) : Jerzy A. Owczarek

It is certified that error appears in the above-identified patent and that said Letters Patent is hereby corrected as shown below:

Col. 5, line 16, after "casing" insert --10--.

Signed and Sealed this

Twenty-second Day of February, 1994

*Attest:*

*Attesting Officer*

BRUCE LEHMAN

*Commissioner of Patents and Trademarks*